US011834241B2

(12) United States Patent
Samaras et al.

(10) Patent No.: US 11,834,241 B2
(45) Date of Patent: Dec. 5, 2023

(54) CONTAINER CARRIER WITH REGISTRATION APERTURES

(71) Applicant: ILLINOIS TOOL WORKS INC., Glenview, IL (US)

(72) Inventors: Christopher J. Samaras, Tinley Park, IL (US); Rachell L. Slovik, Bartlett, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/637,879

(22) PCT Filed: Oct. 7, 2020

(86) PCT No.: PCT/US2020/054485
§ 371 (c)(1),
(2) Date: Feb. 24, 2022

(87) PCT Pub. No.: WO2021/080771
PCT Pub. Date: Apr. 29, 2021

(65) Prior Publication Data

US 2022/0274754 A1 Sep. 1, 2022

Related U.S. Application Data

(60) Provisional application No. 62/925,068, filed on Oct. 23, 2019.

(51) Int. Cl.
*B65D 71/50* (2006.01)
*B65B 27/04* (2006.01)

(52) U.S. Cl.
CPC ..... *B65D 71/504* (2013.01); *B65B 27/04* (2013.01)

(58) Field of Classification Search
CPC ..... B65D 71/50; B65D 71/504
(Continued)

(56) References Cited

U.S. PATENT DOCUMENTS 2,936,070 A 5/1960 Ougljesa
3,946,535 A 3/1976 Bourgeois et al.
(Continued)

FOREIGN PATENT DOCUMENTS

GB 1525073 9/1978
WO WO 2016/001619 1/2016
WO WO 2019/193344 A2 10/2019

OTHER PUBLICATIONS

European Patent Office (EPO), Rijswijk, NL, International Search Report, Form PCT/ISA/210 for International Application No. PCT/US2020/054485, dated Feb. 8, 2021 (5 pp.).
(Continued)

*Primary Examiner* — Bryon P Gehman
(74) *Attorney, Agent, or Firm* — Pauley Erickson & Swanson

(57) ABSTRACT

A container carrier with a uniform pitch applicating feature for applying container carriers onto containers to form a multipackage. A uniform series of apertures is formed on the container carrier in the machine direction of a multipack carrier. Application machines may use the apertures for synchronizing the container carrier material to the containers, thereby making it container pitch independent. The resulting internal features of the carrier that would receive the containers can then be varied to best match the containers with little to no impact to the application machine.

10 Claims, 6 Drawing Sheets

(58) Field of Classification Search
USPC ..... 206/147, 150
See application file for complete search history.

(56) References Cited

U.S. PATENT DOCUMENTS

| | | | |
|---|---|---|---|
| 7,775,348 | B2 | 8/2010 | Olsen et al. |
| 2019/0276211 | A1 | 9/2019 | Olsen |

OTHER PUBLICATIONS

European Patent Office (EPO), Rijswijk, NL, Written Opinion of the Int'l Searching Authority for Int'l Appln No. PCT/US2020/054485, Form PCT/ISA/237, dated Feb. 8, 2021 (6 pp.).
EPO (Munich, DE), Office Action for European Patent Application No. 20797617.6, dated Oct. 7, 2020 (9 pages).
WaveGrip carrier, www.Twitter.com/www.wavegrip.com, Mar. 7, 2017, (9 pages).

CONTAINER CARRIER WITH REGISTRATION APERTURES

CROSS REFERENCE TO RELATED APPLICATION

This application is a National Phase filing of PCT International Patent Application Number PCT/US2020/054485, filed on 7 Oct. 2020, which claims the priority of U.S. Provisional Patent Application Ser. No. 62/925,068, filed 23 Oct. 2019.

These applications are hereby incorporated by reference herein in their entirety and is made a part hereof, including but not limited to those portions which specifically appear hereinafter.

BACKGROUND OF THE INVENTION

Field of the Invention

This invention relates to a container carrier with a uniform pitch applicating feature having container receiving apertures for unitizing a plurality of containers.

Description of Prior Art

Conventional container carriers are often used to unitize a plurality of similarly sized containers, such as cans, bottles, jars and boxes and/or similar containers that require unitization. Carriers are generally planar arrays of rings, sometimes referred to as a "six-pack carrier." Flexible plastic ring carriers are one such conventional container carrier. Carriers are applied to containers of various sizes and shapes along various points along the sidewall or under the chime of the container. A preferable machine would be capable of application of a container carrier to a wide range of container sizes.

Flexible plastic ring carriers having a plurality of container receiving apertures, typically of an oval, round or rectangular configuration, that each engage a corresponding container may be used to unitize groups of four, six, eight, twelve or other suitable groups of containers into a convenient multipackage. Conventional carriers are arranged in aligned arrays of longitudinal rows and transverse ranks of container receiving apertures. Flexible ring carriers may include a handle that extends upwardly from the carrier to enable a consumer to carry the package from the top (called a "top lift carrier") or outwardly from a side of the carrier to enable a consumer to carry the package from the side (called a "side lift carrier").

Conventional carriers are often applied to various containers with applicating machines that include a circular jaw drum used to apply carriers to individual containers. The jaw drum may stretch the container carrier for application to the individual containers. Individual containers may also be rotated, either manually or mechanically, into a preferred orientation after packaging randomly oriented containers in the container carrier. The stretching of the carrier and/or rotation of the containers may destroy the integrity of the flexible container carrier through excessive torque applied to the respective thermoplastic rings within the container carrier.

Prior art applicating machines, systems and methods generally require several different versions or configurations of machines to accommodate different container carriers, package sizes and package configurations. Machines are traditionally a limitation on the range of container diameters, size of packages or configuration of packages that can be effectively packaged by a single system.

Finally, different machines or complex set-up procedures would also be required for containers having different sizes, heights and/or widths, resulting in different lengths, called "pitch" herein, between each adjacent container. As such, different machines and/or set-up procedures are traditionally required to bring the carrier to the correct position around the container. Therefore, a need arises for a container carrier and associated application of container carriers with an improved more universal application without detriment to the integrity of the carrier.

SUMMARY OF THE INVENTION

The present invention is directed to a uniform pitch application pitch feature on a container carrier for packaging containers that include an arrangement of container receiving apertures that are configured to permit placement over containers and permit carrying a unitized package of containers.

The invention is for the application of the container carrier onto containers to form a multipackage. This invention adds a uniform series of apertures to the container carrier in the machine direction of a multipack carrier. This allows for application machines to be developed that use the apertures for synchronizing the container carrier material to the containers, thereby making it container pitch independent. The internal features of the carrier that would receive the containers can then be varied to best match the containers with little to no impact to the machinery. The application of the container carrier may be accomplished via rolling the carriers out via a circular jaw drum or similar; or via an application by pushing the carriers onto the containers from above.

The carrier is suitably configured with a combination of webs and container receiving apertures that coupled with the apertures for synchronization, permit application to the containers without the need to stretch the carrier. Traditional carriers will stretch at approximately 20-50%, more preferably at 30-35%. Traditional carriers also typically include oval, round, rectangular or triangular shaped container receiving apertures.

The subject invention is directed to a container carrier that includes an arrangement of container receiving apertures and intermediate cutouts with centrally located cutouts. The apertures for synchronizing the container carrier material to the containers are generally located along the perimeter edges and/or the center of the string of carriers. The resulting carrier is configured to enable placement over corresponding containers to result in a tight, unitized bricklike package with the cutouts configured as finger tabs or a handle for a consumer to carry the package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
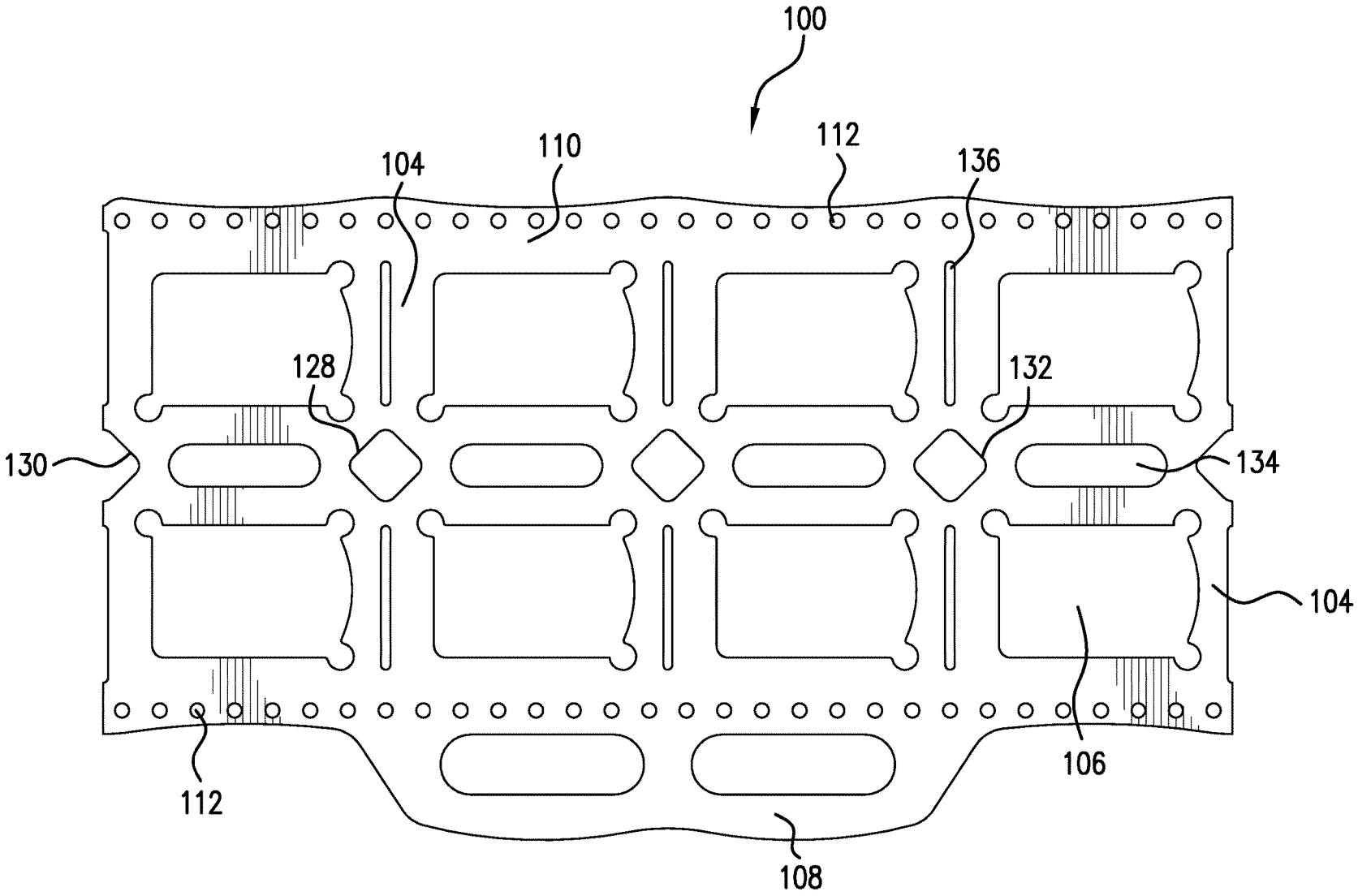
FIG. 1 is a front elevational view of a uniform pitch applicating feature on a container carrier according to one preferred embodiment of the subject invention.

FIGS. 1-6 show a uniform pitch 120, 122, 124 applicating feature for a container carrier 100 and for unitizing multiple containers 102 into a resulting unitized multipackage 138. Although FIGS. 1-6 illustrate various structures for the uniform pitch applicating feature of the invention, the illustrations are exemplary, and the invention is not limited to the container carriers 100 or multipackages 138 shown in the figures.

The container carrier with the uniform pitch applicating feature is preferably for containers 102 that are cans or bottles, but any other commonly unitized container may be used with the uniform pitch applicating feature according to this invention. The containers 102 are preferably, though not necessarily, like-sized within a single container carrier 100 utilizing the uniform pitch applicating feature.

Figure 6:
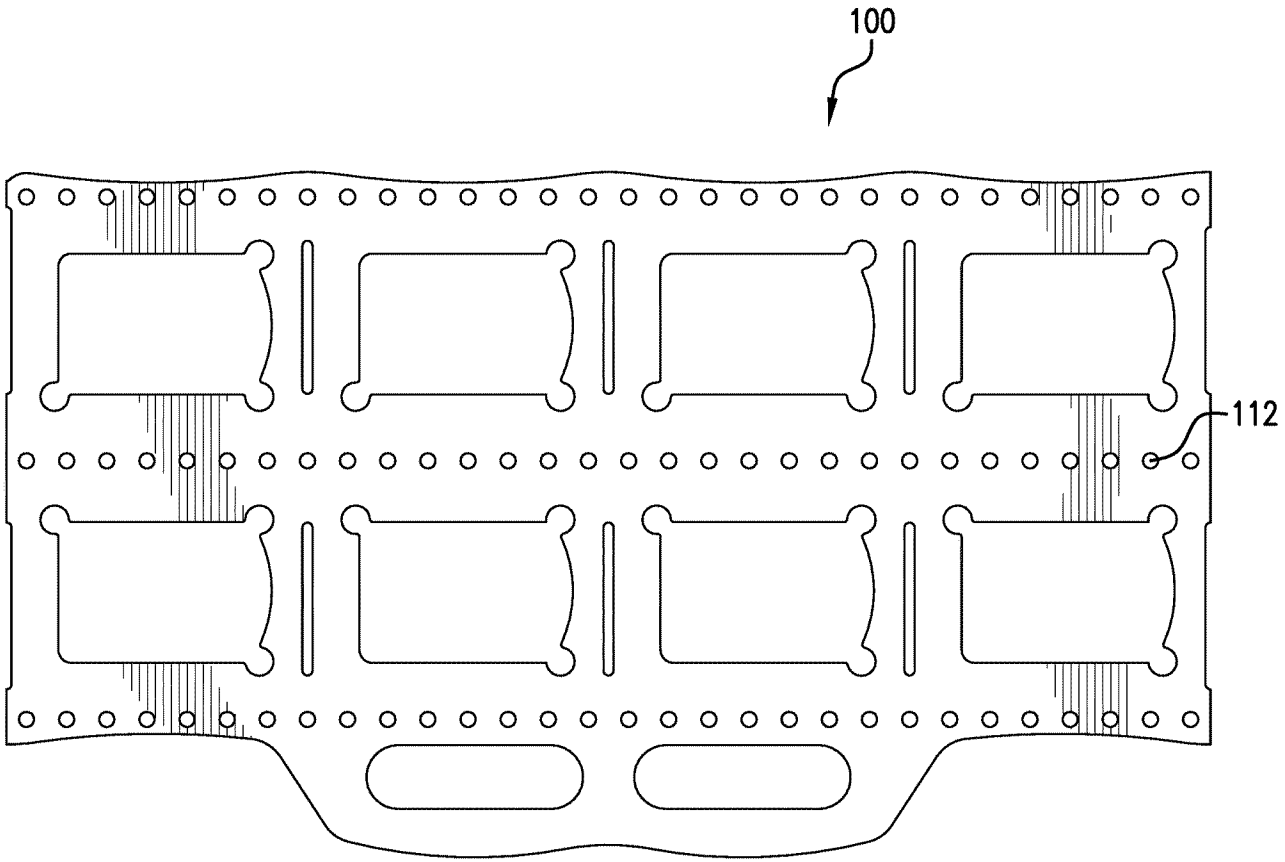
FIG. 6 is a front elevational view of a uniform pitch applicating feature on a container carrier according to an embodiment of the subject invention.

Each container carrier 100 with the uniform pitch applicating feature preferably includes a single sheet layer having a width and length defining therein a plurality of flexible bands 104 further defining a plurality of container receiving apertures 106, each for receiving a container 102. The plurality of container receiving apertures 106 are preferably arranged in two longitudinal rows and multiple transverse ranks so as to form an array of container receiving apertures 106, such as two rows by four ranks for an eight container multipackage 138 as shown in FIGS. 1 and 6. Container receiving apertures 106 are preferably generally slightly elongated in a longitudinal direction of the container carrier 100, as shown in FIGS. 1-2C and 6. While traditional carriers preferably contain 30-35% stretch, the sheet layer allows the container carrier 100 of the subject invention to optimally stretch less than 20%. The container carrier 100 most preferably stretches less than 10%, with the capability of the container carrier 100 to stretch up to 0%.

Figures 2A, 2B, 2C:
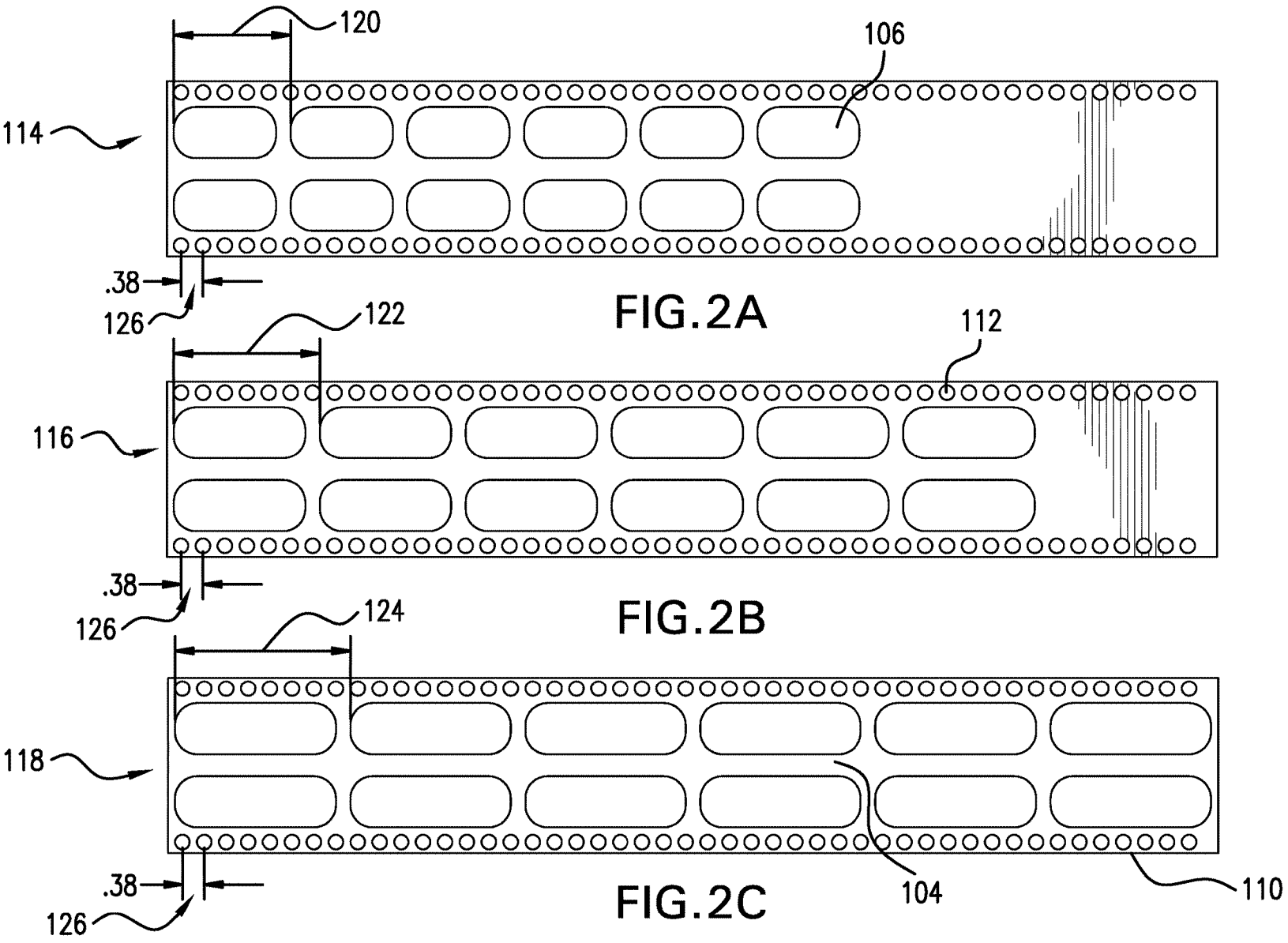
FIG. 2A is a front elevational view of the pitch feature on the container carrier according to an embodiment of the subject invention with a pitch of two inches.
FIG. 2B is a front elevational view of the pitch feature on the container carrier according to one embodiment of the subject invention with a pitch of two and a half inches.
FIG. 2C is a front elevational view of the pitch feature on the container carrier according to another embodiment of the subject invention with a pitch of three inches.

A representative multipackage 138 resulting from the container carrier 100 with the uniform pitch applicating feature includes a plurality of unitized containers 102. A preferred carrier configuration includes bands 104 forming two distinct parallel rows of container receiving apertures 106. Each rank preferably includes two container receiving apertures 106 (one for each row in the carrier). Preferably, each carrier 100 like the one shown in FIG. 1, is manufactured in a generally continuous string of carriers, or container carrier strip 114, 116, 118 (as shown in FIGS. 2A-C, respectively) wherein the carriers 100 are punched or otherwise formed longitudinally adjacent to other carriers. In this manner, a generally continuous string of carriers is formed that may be rolled onto reels or folded into boxes for later unwinding and application to containers 102. The strings of carriers 114, 116, 118 are then cut into individual carriers 100 and formed into individual multipackages 138.

Container receiving apertures 106 and intermediate apertures 128 are preferably formed by the flexible bands 104 in a geometry that results in a uniform application of the carrier 100 to containers 102 to produce a tight unitization of containers 102 within each container carrier 100. In particular, and as shown in FIG. 1, the carrier 100 preferably includes an intermediate aperture 128 formed in a diamond shape. As described, the intermediate aperture 128 is defined as an aperture positioned between both each transverse rank and each longitudinal row of container receiving apertures 106. Each side 130 of each intermediate aperture 128 is preferably parallel to a portion of each adjacent container receiving aperture 106. Each side 130 of each diamond shaped aperture 128 is preferably the same length. In addition, each corner 132 of each diamond shaped aperture 128 preferably includes rounded corners 132.

According to one preferred embodiment, an oval aperture 134 is positioned between each container receiving aperture 106 in transverse ranks. Each transverse oval aperture 134 is preferably positioned midway between each adjacent container receiving aperture 106 in transverse ranks. Each transverse oval aperture 134 is also preferably positioned midway between each adjacent intermediate aperture 128. According to a preferred embodiment, a major axis of the transverse oval apertures 134 is preferably perpendicular to a major axis of additional longitudinal oval apertures 136. Each longitudinal oval aperture 136 is preferably positioned between each container receiving aperture 106 in longitudinal ranks. As shown in FIG. 1, the longitudinal oval apertures 136 are preferably narrower than the transverse oval apertures 134. The carrier 100 may also include features such as a handle 108 for holding the container carrier 100 along either a side or a top of the multipackage 138 and/or a merchandising panel 110 for displaying product and/or promotional information. Additionally, features such as tear tabs and perforations may be included in the carrier 100 to ease removal of the containers 102 from the container carrier 100.

As shown, the container carrier 100 may comprise a plurality of registration apertures 112 positioned longitudinally along (the handle 108 and/or panel 110) of the container carrier 100. As shown in FIG. 1, the plurality of registration apertures 112 may be positioned along outer perimeters of the container carrier 100 such as the handle 108 and/or the panel 110. Alternatively, as shown in FIG. 6, the plurality of registration apertures 112 may also be positioned in other longitudinal rows such as down the center of the transverse ranks. As another alternative, the plurality of registration apertures 112 may be arranged in any sort of repeatable pattern across the container carrier 100 and the string or strip of container carriers 114, 116, 118. It is to be understood that the plurality of registration apertures 112 are not limited to their positions disclosed in the figures, and that any number of registration apertures 112 may be present at any number of locations on the container carrier 100.

The outer perimeters of the container carrier 100 may include merchandising information, proof of purchase information, pricing, scannable codes, marketing material and/or other designs and/or information relevant to the multipackage 138. The registration apertures 112 may aid in application of the container carrier 100, in particular the container receiving apertures 106 of the container carrier 100, onto containers 102. As shown in FIGS. 1-2C, the registration apertures 112 are equidistant from each other along a uniform container carrier strip 114, 116, 118. This equidistant spacing results in a uniform pitch 120, 122, 124 application along the entire surface area of the strip. This allows the internal features of the uniform container carrier strip (for example, adaptation to cans or bottles) to change, thereby allowing for variations in the pitch 120, 122, 124 of each container 102 without the need to make any modifications to an applicating machine 144, 200, 300. This is further illustrated in FIGS. 2A-C.

FIG. 2A shows a two-inch pitch 120 on a container carrier strip 114. As shown, a center-to-center distance 126 between the centers of each registration aperture 112 is 0.38 inches. FIG. 2B shows a 2.5-inch pitch 122 on another container carrier strip 116. While this pitch 122 is different form that in FIG. 2A, the distance 126 between the centers of each registration aperture 112 in FIG. 2B remains 0.38 inches. Further, FIG. 2C shows a three-inch pitch 124 on a container carrier strip 118. Again, while this pitch 124 is different from that of FIG. 2A and FIG. 2B, the distance 126 between the centers of each registration aperture 112 in FIG. 2C is also 0.38 inches. Therefore, the applicating machine 144, 200, 300 of this invention is able to operate independently of pitch. Dimensions may be adjusted depending on the container and carrier desired.

Figure 3:
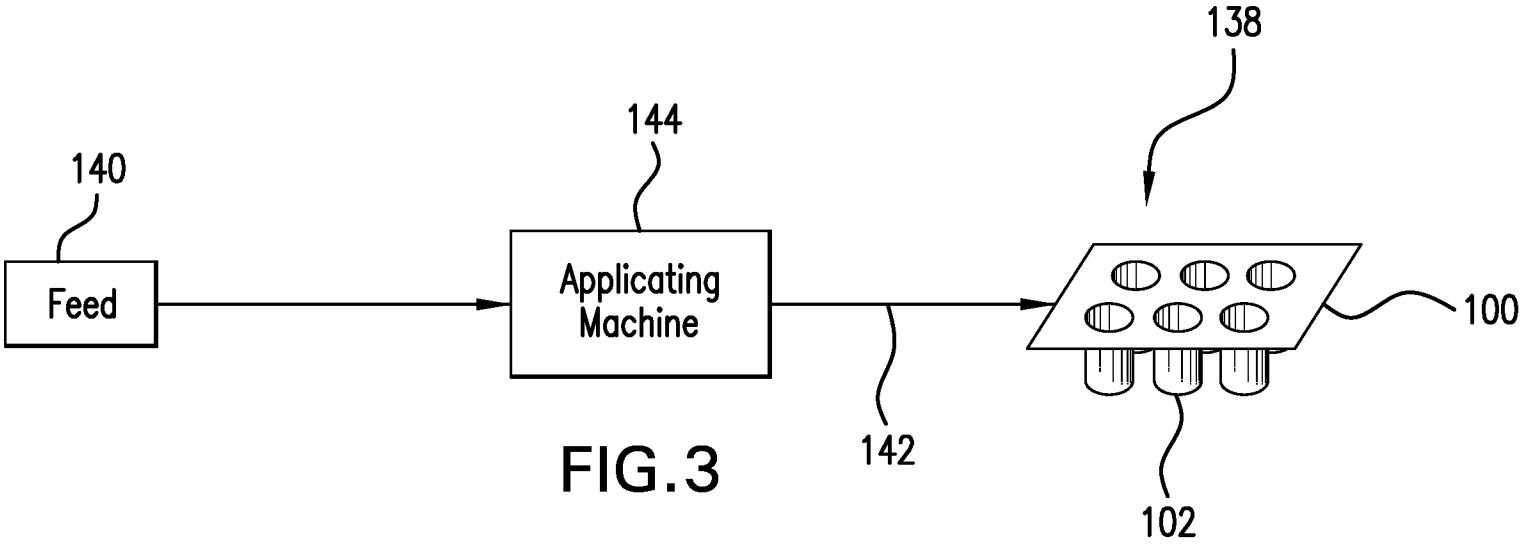
FIG. 3 is a schematic of the application of the pitch feature on the container carrier to form a multipackage according to another embodiment of the subject invention.

In one embodiment of this invention, the registration apertures 112 are preferably adapted to receive insertion pins 202, 302. The insertion pins 202, 302 may manipulate the container carrier 100 so as to sustain proper placement of the container carrier 100 over containers 102 during placement to form a multipackage 138. As shown in FIG. 3, the application of the container carriers to form a multipackage 138 includes a feed 140 of the container carrier strips 114, 116, 118, and an applicating machine 144 to apply the carrier strip 114, 116, 118 to a plurality of containers 102 via a centerline 142 of the applicating machine 144. A resulting multipackage 138 is formed after individual container carriers 100 are applied to the proper number of containers 102. As shown schematically in FIG. 3, the feed 140 of container carrier strips 114, 116, 118 move through the machine 144 where the feed 140 is applied to containers 102 and then separated into individual, unitized multipackages 138. Due to the uniform pitch applicating feature of the subject invention, if a uniform group of like-sized containers having a different size requires packaging and/or if a different carrier is required, a separate machine is unnecessary and no reconfiguration or adjustments are necessary to the applicating machine 144.

Therefore, the applicating machine 144 for packaging multiple containers 102 in multiple size packages according to the subject invention permits the use of a single machine in combination with a variety of sizes of containers and/or sizes and configurations of carriers and/or packages.

Figure 4:
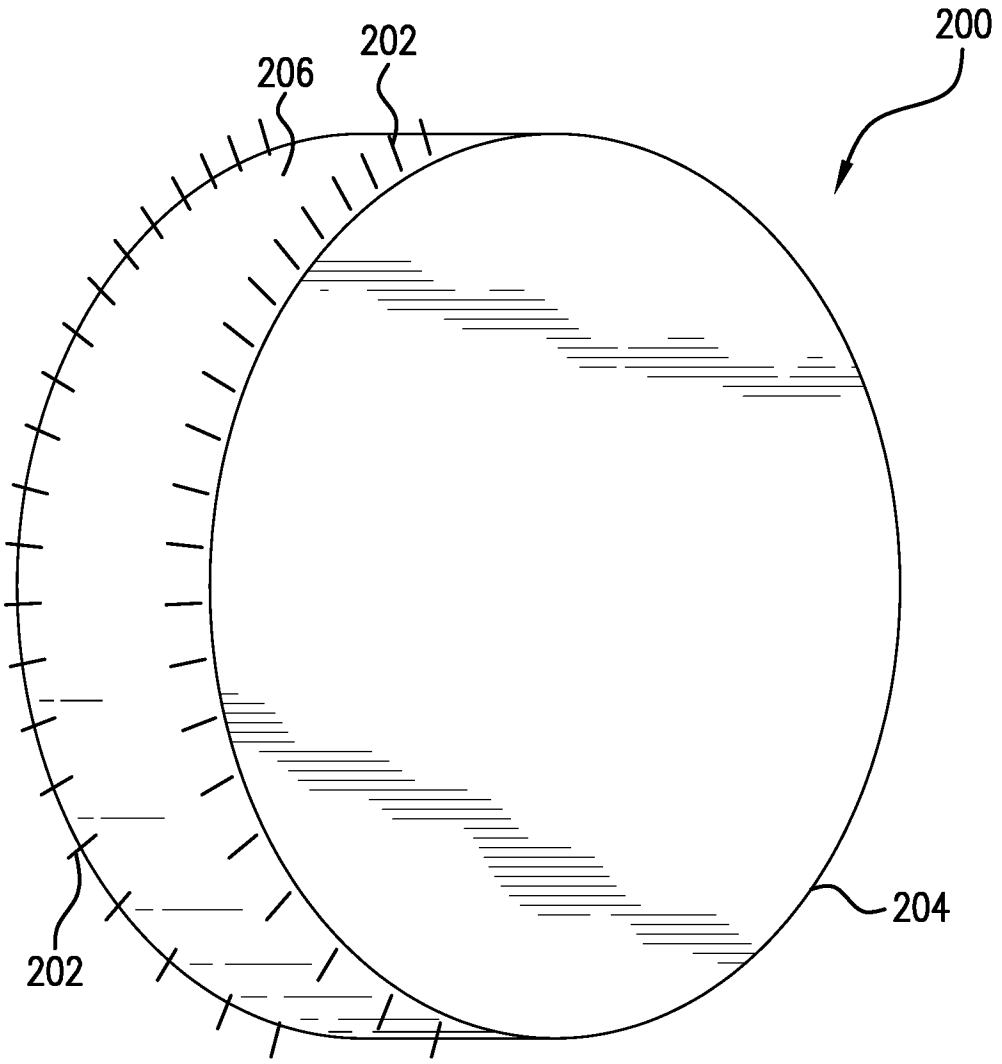
FIG. 4 is a side schematic view of an applicating machine for the pitch feature on a container carrier according to one embodiment of the subject invention.

In one embodiment as shown in FIG. 4, the container carrier strip 114, 116, 118 preferably moves through a machine 200 from a reel stand 206 where carriers 100 are dispensed in a continuous string and ultimately to packages where each carrier is separated into a unitized package, each package containing a plurality of uniform containers 102. The machine 200 includes a frame and a plurality of pins 202 positioned along the outer perimeters of the reel stand 206. The reel stand 206 is adapted to feed the carrier strip 114, 116, 118 through the machine 200 as a jaw drum 204. The plurality of pins 202 are adapted to insert into the plurality of registration apertures 112 along the container carrier strip 114, 116, 118 where the jaw dram machine 200 is adapted to draw the container carrier strip 114, 116, 118 via the pins 202, and apply the carrier strip 114, 116, 118 to the plurality of containers 102 by releasing the registration apertures 112 from the pins 202 upon application to the containers 102.

Figure 5:
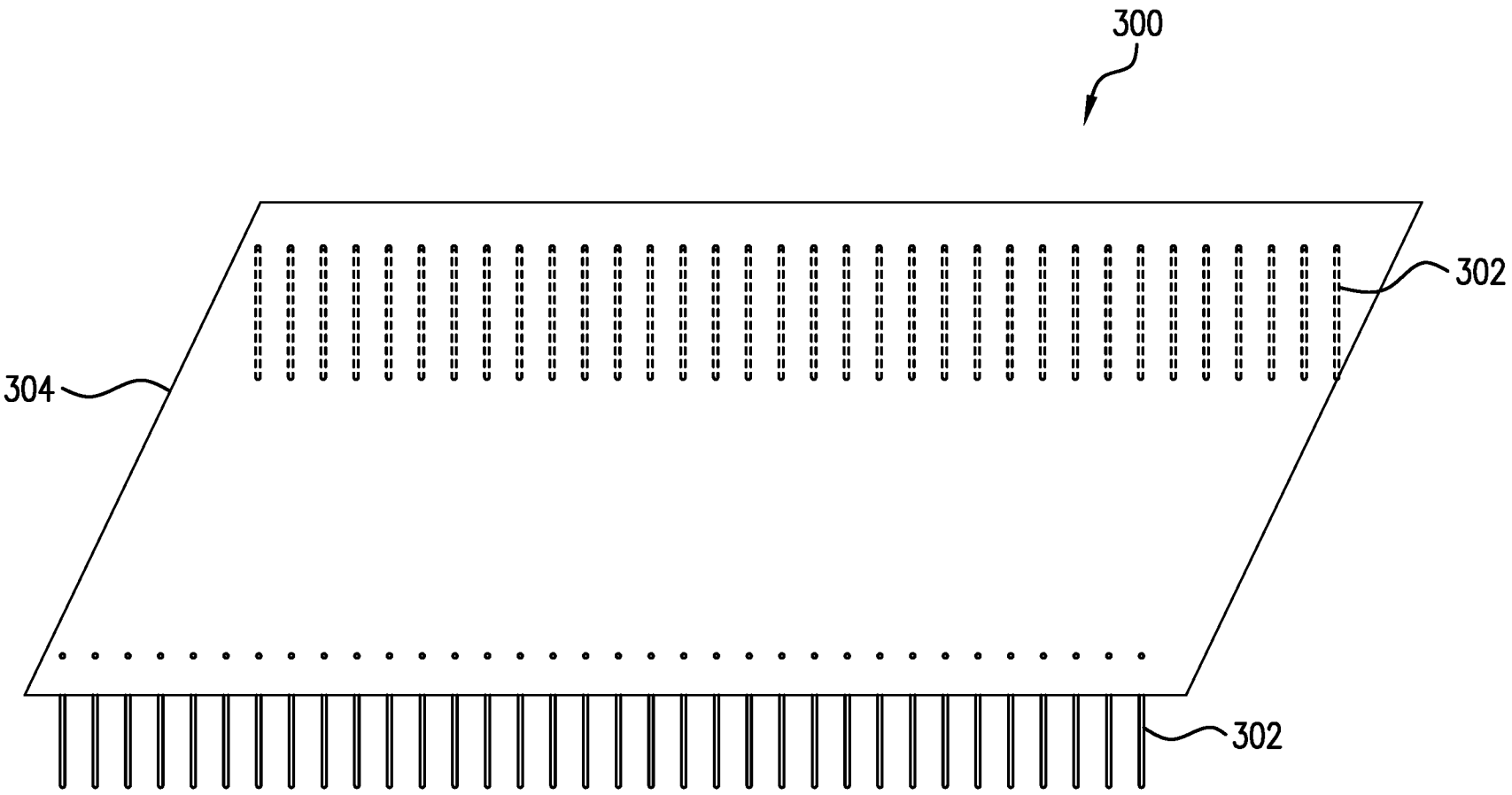
FIG. 5 is a side schematic view of an application machine for the pitch feature on a container carrier according to yet another embodiment of the subject invention.

In another embodiment of the invention as shown in FIG. 5, the strip 114, 116, 118 preferably moves through a machine 300 from a folded stack in boxes where carriers are dispensed in a continuous string and ultimately to packages where each carrier is separated into a unitized package, each package containing a plurality of uniform containers 102. The machine 300 in this embodiment includes a linear frame 304. The linear frame 304 may be rectangular and function like a conveyor belt. The frame or belt 304 includes a plurality of pins 302 positioned along at least one perimeter of the frame 304. The machine 300 is adapted to feed the carrier strip 114, 116, 118 through the machine 300 as a conveyor belt. The plurality of pins 302 are adapted to insert into the plurality of registration apertures 112 along the strip 114, 116, 118 where the machine 300 is adapted to draw the strip 114, 116, 118 via the pins 302 and push each container receiving aperture 106 of the container carrier 100 onto a container 102 to form the multipackage 138, after which the pins 302 are released from the container carrier 100.

While in the foregoing specification this invention has been described in relation to certain preferred embodiments thereof, and many details have been set forth for purpose of illustration, it will be apparent to those skilled in the art that the uniform pitch application feature is susceptible to additional embodiments and that certain of the details described herein can be varied considerably without departing from the basic principles of the invention.

The invention claimed is:

1. A container carrier for unitizing a plurality of containers comprising:

a plurality of flexible bands that form an array of container receiving apertures, wherein the array of container receiving apertures includes a pitch of between two and three inches, the array arranged in longitudinal rows and transverse ranks; and a plurality of registration apertures aligned on each longitudinal row of the container carrier adjacent to, and outside of, the array of container receiving apertures, each registration aperture defines a respective center, wherein the plurality of registration apertures have a measurable center-to-center distance between adjacent registration apertures adapted for the respective pitch of two to three inches and wherein the measurable center-to-center distance between adjacent registration apertures of the plurality of registration apertures is the same regardless of the pitch of the container receiving aperture.

2. The container carrier of claim 1 wherein the plurality of registration apertures extend along an outside perimeter of the container carrier.

3. The container carrier of claim 1 further comprising at least one of a handle and a panel formed adjacent to the array of container receiving apertures.

4. The container carrier of claim 1 wherein the array of container receiving apertures form a container carrier strip.

5. The container carrier of claim 4 wherein the plurality of registration apertures extend to the container carrier strip.

6. The container carrier of claim 5 wherein the container carrier strip has a stretch of less than 20%.

7. The container carrier of claim 5 wherein the container carrier strip has a stretch of less than 10%.

8. The container carrier of claim 1 wherein the plurality of registration apertures are circular.

9. The container carrier of claim 1 wherein the plurality of registration apertures are a consistent shape.

10. The container carrier of claim 1 further comprising a diamond shaped aperture formed between each transverse and longitudinal pair of container receiving apertures, wherein each side of each diamond shaped aperture is parallel to a portion of the adjacent container receiving aperture.

* * * * *